United States Patent [19]

Cote

[11] 4,432,489

[45] Feb. 21, 1984

[54] PIE CARTON

[75] Inventor: Raymond A. Cote, Taylorsville, N.C.

[73] Assignee: Champion International Corporation, Stamford, Conn.

[21] Appl. No.: 388,499

[22] Filed: Jun. 14, 1982

[51] Int. Cl.[3] ..... B65D 5/54; B65D 85/36

[52] U.S. Cl. ..... 229/22; 206/551; 229/8

[58] Field of Search ..... 229/22, 18, DIG. 13, 229/44 R, 33, 36, 16 R, 8; 206/45, 32, 551, 424, 521

[56] References Cited

U.S. PATENT DOCUMENTS

| | | | |
|---|---|---|---|
| Re. 29,185 | 4/1977 | Tolaas | 229/22 |
| 2,584,379 | 2/1952 | Chmielewski | 229/22 X |
| 2,966,293 | 12/1960 | Goldsholl | 229/16 R |
| 3,623,650 | 11/1971 | Watts | 229/22 X |
| 3,876,131 | 4/1975 | Tolaas | 229/22 |
| 4,155,500 | 5/1979 | Dutcher | 229/22 X |
| 4,313,542 | 2/1982 | Roberts et al. | 229/22 X |

*Primary Examiner*—William Price
*Assistant Examiner*—Gary E. Elkins
*Attorney, Agent, or Firm*—Evelyn M. Sommer

[57] ABSTRACT

Disclosed is a carton especially adapted to package single servings of pie. The carton has a triangular shape due to a triangular top closure and a bottom support panel. A trapezoidal end wall connects the top and bottom panels at the bases of the respective triangles and slants outwardly from bottom to top. The bottom panel has inner side wall panels attached to it. The inner side wall panels are secured in a vertical upright position by means of corner flaps which are preferably secured to the outer surfaces of the inner side wall panels. The top closure panel has downwardly extending outer side walls which telescope over the inner side wall panels. The fragile pie crust is protected by the slanted end wall, overlapping corner flaps, and arcuate or rounded surfaces as required, at the juncture of the end wall and/or outer side wall panels with the top closure panel.

4 Claims, 13 Drawing Figures

Fig. 1.
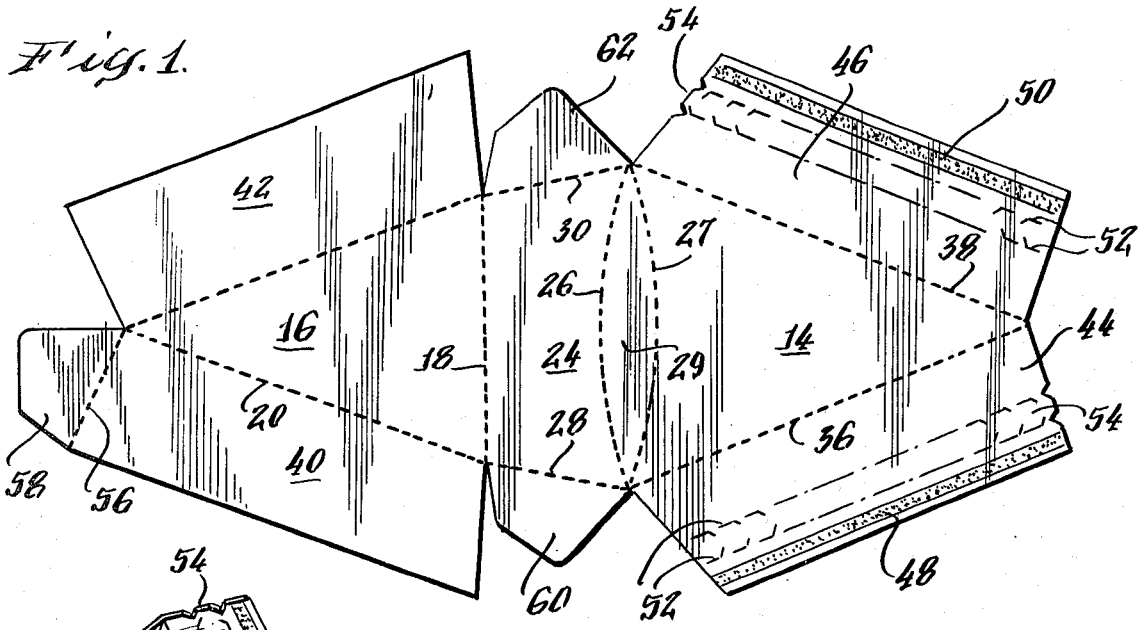
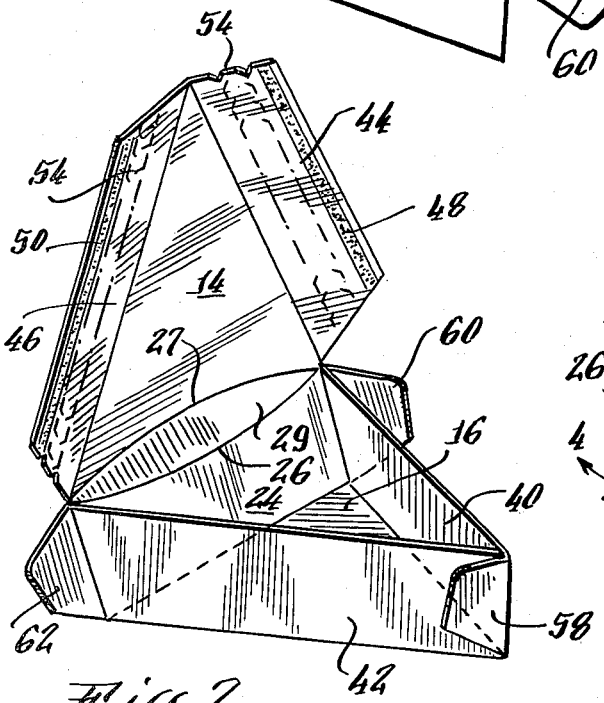
Fig. 2.
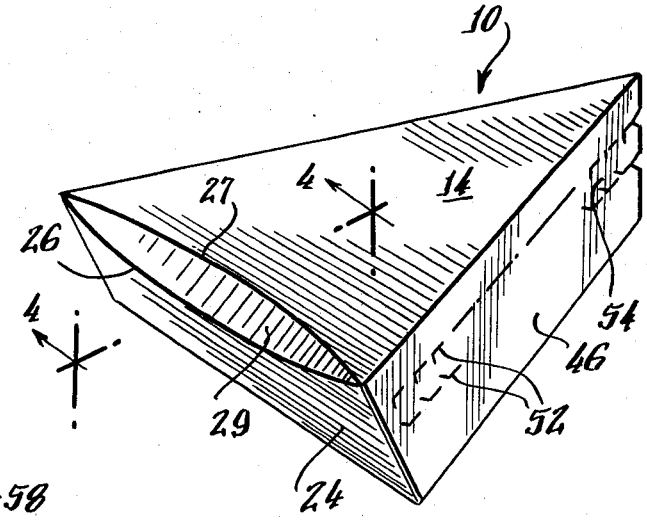
Fig. 3.
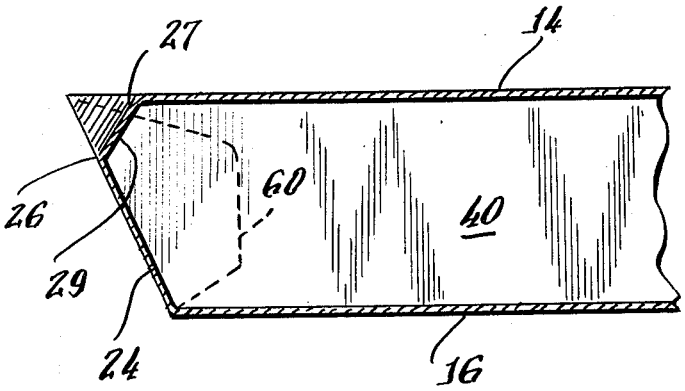
Fig. 4.

Fig. 10.
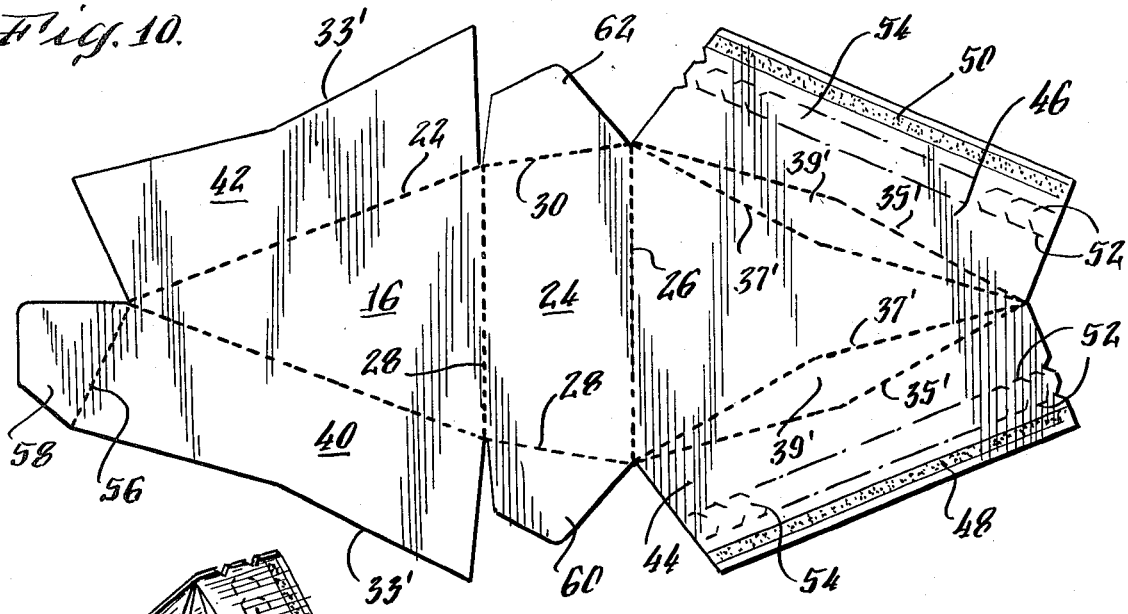
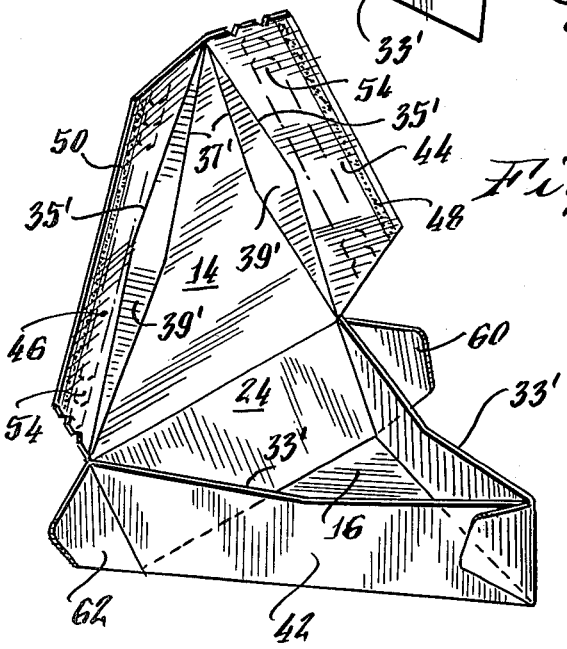
Fig. 11.
Fig. 12.
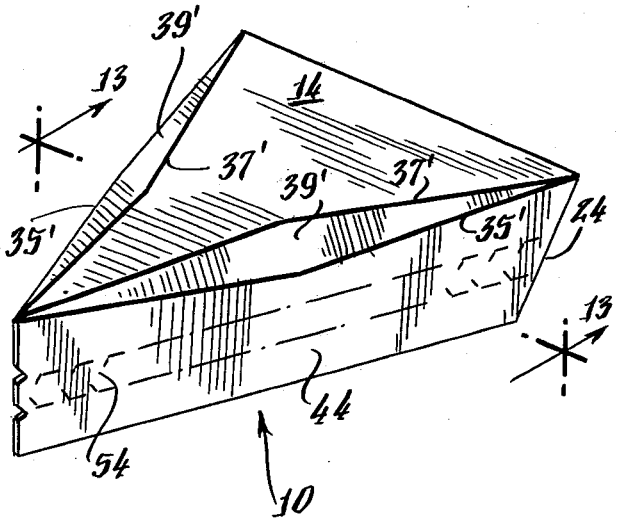
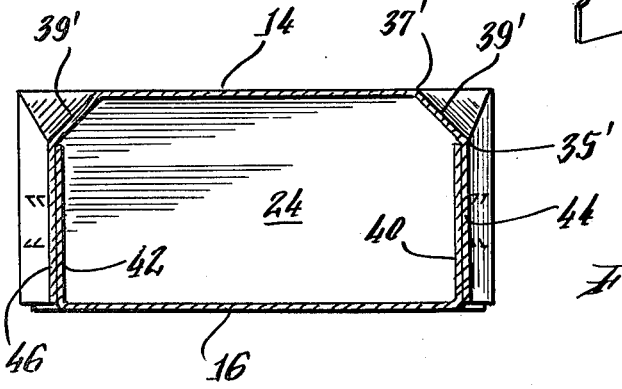
Fig. 13.

PIE CARTON

BACKGROUND OF THE INVENTION

1. Field Of The Invention

This invention relates to an improved carton for packaging single servings of pie, and more specifically to a carton of this type which is attractive in appearance and provides adequate protection for its contents.

2. Description Of Prior Art

U.S. Pat. No. 3,876,131 and U.S. Pat. No. Re. 29,185, disclose triangularly-shaped cartons useful for packaging triangularly-shaped food products, such as slices of pizza. The cartons are adapted to hold the product during storage and heating. Heating by microwave oven is facilitated by openings which permitted circulation of air through the carton during the heating process, but which could be sealed prior to use. The openings are preferably made in the bottom panel and in the adjoining end wall panel, and are normally covered by a removable strip of film to protect the product from contamination during storage. These disclosures do not, however, identify structural design features necessary to accommodate a single-serving slice of pie of the dessert-type which typically has a thin outer shell of a baked pastry crust and contains a filling of fruit or the like.

Dessert-type pies must be carefully protected from breakage, as well as drying out and contamination. Pies of this type are typically cut into single, wedge-shaped portions. The apex of this wedge is particularly fragile and is easily breakable. Similarly, the area of crust which extends around the base of the wedge and at the juncture of the top and rear of the wedge is also easily broken. While the prior art had developed wedge-shaped cartons, there was no known paperboard carton adapted to package a dessert-type pie in single-serving, wedge-shaped portions and afford a degree of protection to the pie satisfactory for normal abuse during shipping and handling. Dessert-type pies need special protection if they are to survive shipment and handling so that they remain attractive in appearance when finally served.

Accordingly, in U.S. Pat. No. 4,313,542, assigned to the same assignee as the present invention, an improved carton for use in containing a wedge-shaped piece of pie and a blank for forming a carton of this type is disclosed. The carton comprises: a triangular bottom panel havng a base edge and converging side edges; a trapezoidal end wall hingedly connected to the base edge of said bottom panel and extending upwardly and outwardly therefrom to a top edge, wherein the top edge is longer than said base edge; a triangular top panel hingedly connected to said end wall along said top edge, said top panel being substantially identical in shape to said bottom panel but longer from the apex to said top edge than the distance from the apex to said base edge of said bottom panel, and extending parallel to said bottom panel; inner side wall panels secured to the converging edges of said bottom panel and extending upwardly therefrom; outer side wall panels secured to the converging edges of said top panel and extending downwardly therefrom and outwardly of said inner side wall panels; corner flaps connecting the converging ends of said inner side walls and connecting the ends of said end wall to said inner side walls; and means securing said inner and outer side wall panels in face contact.

When the carton is erected, the slanted end wall aids in precluding undue contact of the fragile pie crust with the carton, but the sharp corners at the juncture of the end wall and top panel and top panel and side wall panels tend to erode and break the crust upon contact therewith during shipment and handling of the carton.

SUMMARY OF THE INVENTION

In order to prevent the pie crust of the enclosed pie adjacent the edges of the single slice from being bumped, broken and crumbled during shipment and handling of the pie carton, the pie carton of U.S. Pat. No. 4,313,542 has been improved by providing arcuate or rounded surfaces, as required, at the juncture of the end wall and/or outer side wall panels with the top panel. These arcuate or rounded surfaces are formed by providing spaced, facing arcuate score lines which converge at their ends or score lines in the shape of a parallelogram to form a diamond-like area around the juncture of the end wall and/or side wall panels with the top panel.

BRIEF DESCRIPTION OF THE DRAWINGS

Further objects and advantages of the invention will become apparent from the following description and claims, and from the accompanying specification, wherein:

FIG. 1 is a plan view of a blank for forming a pie carton of the present invention;

FIG. 2 is a perspective view illustrating the folding of the blank of FIG. 1 into a pie carton;

FIG. 3 is a perspective view of a pie carton formed from the blank of FIG. 1;

FIG. 4 is a cross-sectional view taken substantially along the plane indicated by line 4—4 of FIG. 4;

FIG. 10 is a plan view of another alternate form of a blank for forming a pie carton in accordance with the present invention;

FIG. 11 is a perspective view of the blank of FIG. 10 partially folded to form a pie carton;

FIG. 12 is a perspective view of a pie carton formed from the blank of FIG. 10; and FIG. 13 is a cross-sectional view taken substantially along the plane indicated by line 13—13 of FIG. 12.

DETAILED DESCRIPTION OF THE PREFERRED EMBODIMENT

The carton provided by the present invention is generally of triangular shape and has a suitable design for providing an adequate degree of protection to a piece of dessert pie placed therein to protect it from damage during shipment and handling.

Figure 5:
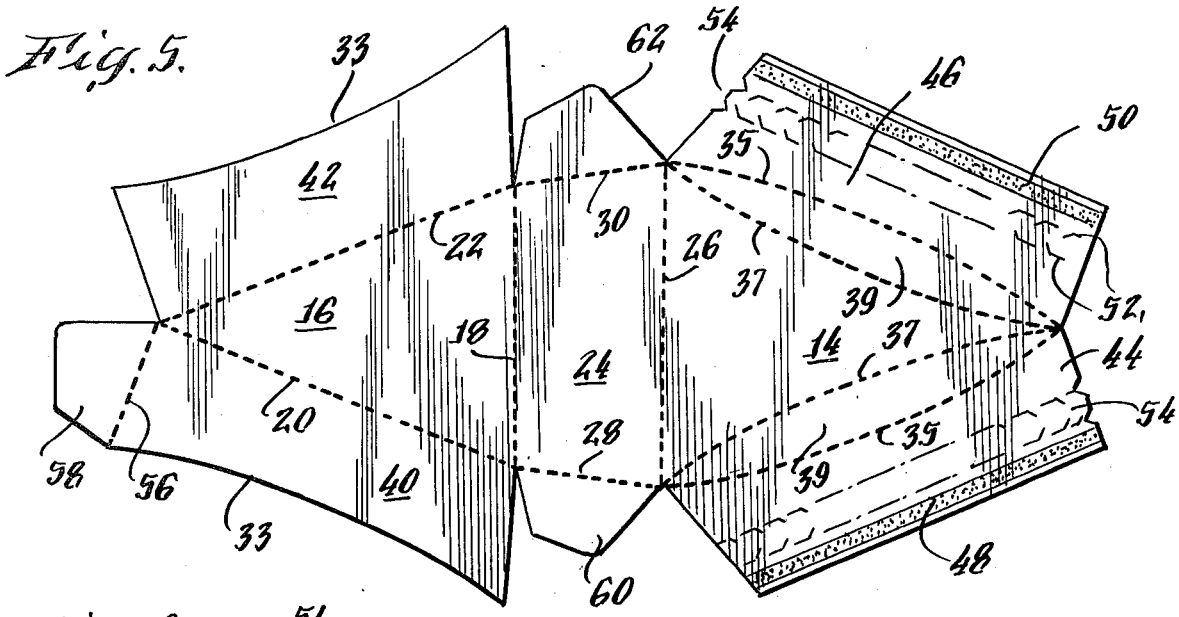
FIG. 5 is a plan view of an alternate form of a blank for forming a pie carton in accordance with the present invention.
Figure 6:
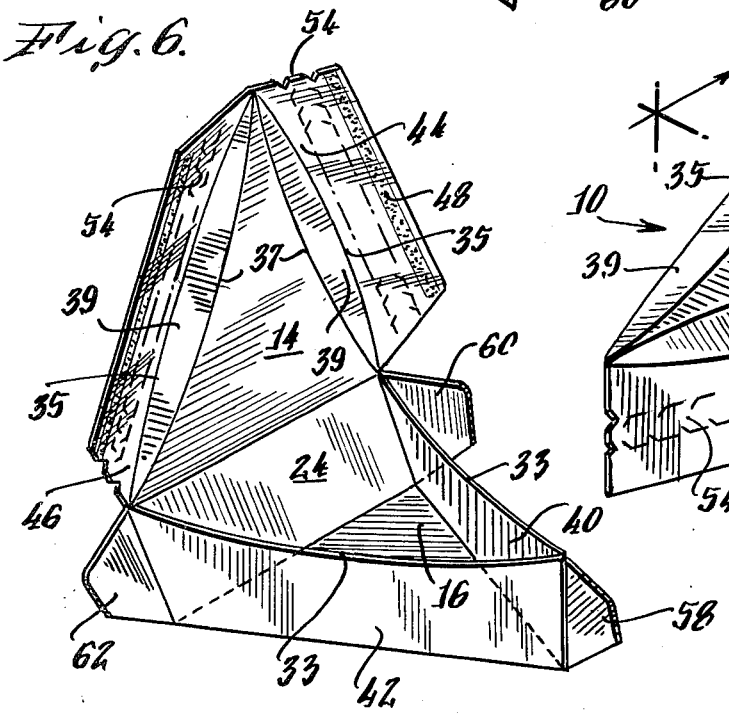
FIGS. 6 and 7 are perspective views of the blank of FIG. 5 partially folded to form a pie carton.
Figure 8:
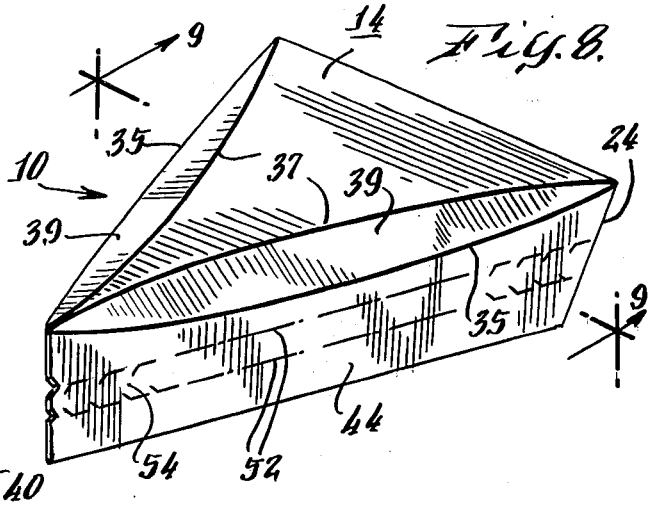
FIG. 8 is a perspective view of a pie carton formed from the blank of FIG. 5.
Figure 7:
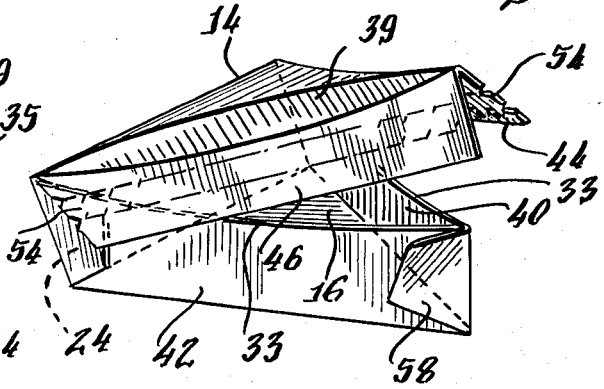
Figure 9:
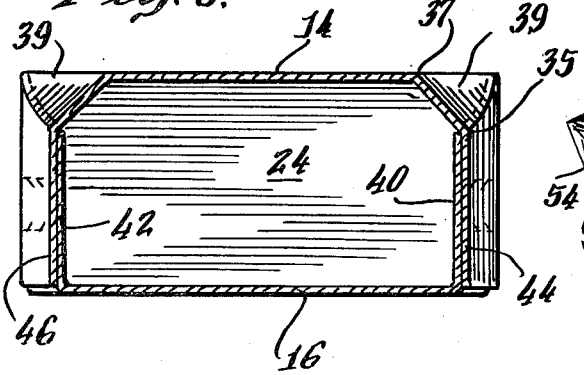
FIG. 9 is a cross-sectional view taken substantially along the plane indicated by line 9—9 of FIG. 8.

One form of the carton generally designated as 10 is illustrated in FIG. 3. The blank for forming the carton shown in FIG. 3 is shown in FIG. 1. Alternative forms of a blank for forming the carton are shown in FIGS. 5 and 10, with similar elements being designated by the same numbers.

Reference is now made to FIG. 1 which shows a blank for forming a carton according to the present invention as shown in FIG. 3. This carton is shown in FIGS. 2 through 4 when viewed from various directions and along certain sections. Successive stages of construction are shown in FIGS. 2 and 3. The blank shown in FIG. 1 is viewed from what will be the inside of the carton.

The blank is shown to have a triangular bottom panel 16 having a base edge 18 and converging side edges 20 and 22. A trapezoidal end wall 24 is hingedly connected to the base edge 18 of the bottom panel 16. The end wall 24 has a concave top edge 26, which converges at its corners with a spaced, arcuate convex top edge 27, to define a generally oval or elliptical area 29 therebetween. The top edges 26 and 27 are longer than the base edge 18. The end wall 24 also has side edges 28 and 30.

Hingedly connected to the top edge 27 of the end wall panel 24 is a top panel 14. The top panel 14 is substantially identical in shape to the bottom panel 16 but is longer from the apex of the triangle where side edges 36 and 38 converge, to the center of top edge 27 than the distance from the apex formed by bottom panel side edges 20 and 22 to the base edge 18 of the bottom panel 16.

By dimensioning the top panel 14, the bottom panel 16 and the end wall panel 24 as described, the end wall panel 24 will slant outwardly from base edge 18 up toward top edges 26 and 27 as can be clearly seen in FIG. 4. This outwardly slanting end wall panel 24 closely conforms to the shape of a pie crust and thereby increases the support for the crust and decreases the likelihood of damage to this portion of a pie. Further, because of the convex and concave converging edges 26, 27, the elliptical area 29 therebetween will be rounded when the carton is assembled to preclude bumping of the pie crust with a shape edge during handling and shipping of the carton.

Inner side wall panels 40 and 42 are connected to bottom panel 16 along side edges 20 and 22, respectively. It can be seen in FIG. 2, for example, that the side wall panels 40 and 42 are folded upwardly about fold lines at side edges 20 and 22 to form vertically upright side wall panels. In the final carton, these side walls 40 and 42 are on the interior of the carton and are overlapped and sealed to outer side wall panels 44 and 46. It can also be seen in FIG. 2 or FIG. 3 that outer side wall panels 44 and 46 are bendably attached to side wall panel 14 about fold lines at the side edges 36 and 38. As shown in FIGS. 5 to 9 the side edges can also be formed by facing convex and concave edges 35, 37 joined at their ends to define a generally elliptical or ovoid area 39 therebetween which when folded provide a rounded or arcuate edge for minimal contact with the pie slice where the crust is joined to the filling. This precludes crumbling of the crust during handling and shipment of the carton. In lieu of convex and concave edges, the edges 35', 37' may be in shape of a parallelogram as shown in FIGS. 10 to 13 also defining an ovoid or elliptical area 39' therebetween to form the rounded juncture at the edges of the top and outer side wall panels. In the blank of either FIG. 5 or FIG. 10 the upper edge 33 and 33', respectively, of inner side wall panels 40 or 42 is complementary shaped to conform to the outline of a mating, adjacent edge 35 or 35', respectively, when outer side panels are abutted with the inner side panels. It is preferable to secure the outer side wall panels 44 and 46 to the inner side wall panels 40 and 42 by suitable means such as glue positioned at areas 48 and 50. Alternatively, the inner and outer side wall panels can be secured by a "Lock-Heat" seal process wherein the paperstock from which the blank is formed is provided with a coating of polyethylene thereon and a jet of superheated air is directed onto the inner and outer side wall panels during the erection process in order to melt the polyethylene coating on such panels to produce a bond therebetween.

It can be seen that in all embodiments both side wall panels 44 and 46 have intermittent cut lines 52 extending along their lengths parallel to the outer edges of outer side wall panels 46 and 48. By providing a pair of intermittent cut lines 52 in this or similar manner, which terminate in tabs shown as 54, tear strips are provided for easily opening the carton. By pulling on tabs 54, the entire strip of material between the intermittent cut lines 52 is removed and the top panel 14 can be lifted upward. By providing an intermittent score line at top edge 26, it is possible to remove the entire top of the container very simply.

In some situations, it is desired to warm the pie in a microwave oven. This may be to defrost a totally frozen pie or simply heat an ambient temperature or conventionally-refrigerated pie to bring it to a moderately warmed condition. The carton of the present invention is particularly well suited for heating in this manner without opening the carton, as it is formed from paperboard. Further, the entire lid can be removed.

Attached to edge 56 of inner side wall panel 40, is a corner flap 58. Corner flap 58 is preferably attached to the outside of inner side wall panel 42 either by gluing or the Lock-Heat process previously described. By securing corner flap 58 to the outside of the inner wall member 42, a sturdier joint is formed between the converging ends of inner side wall members 40 and 42. This fold around flap 58 provides protection to the pointed edge of the individual serving of pie positioned within the container. The flap 58 may also be attached by either method mentioned above to the inner surface of inner side wall panel 42. Alternately, the flap 58 may simply fold into overlapping relationship to inner side wall panel 42, without attachment thereto, in which case the flap 58 is held in place by outer side wall panel 46 when the carton is closed.

Corner flaps 60 and 62 are provided along edges 28 and 30 of the end wall panel 24. As shown in detail in FIGS. 2 and 4, these corner flaps 60 and 62 are bent into contact with the outside surface of inner side wall panels 40 and 42, respectively. As with the corner flap 58, corner flaps 60 and 62 can be secured by means of gluing or the like.

As pointed out above, outer side wall panels 44 and 46 are secured to the outer surfaces of inner side wall panels 40 and 42 by suitable means. As discussed above, this means may comprise areas of glue applied at areas 48 and 50. By positioning the glue areas 48 and 50 in this manner they are below the tear strips defined by tabs 54 and paired intermittent cut lines 52 which appear on both outer side wall panels 44 and 46.

The carton, according to the present invention, will preferably be made of a paperboard material and most preferably will contain a layer of a plastic or wax material adhered thereto to provide a moisture barrier. Virtually all paperboard materials have a grain which is caused by the method of manufacturing. It is preferred to have this grain run along the longitudinal axis of the blank. Thus, the grain will run parallel to a line which passes through the apexes of the top and bottom triangular panels 14 and 16 where their respective side wall edges converge. It is preferred to have the grain run in this direction because the tear strips defined by tap 54 and intermittent cut lines 52 will more easily be removed by pulling where they run substantially parallel to the grain, moreover such grain direction provides the end panel with greater stacking strength.

It will be seen from the Figures that the inner and outside wall members are positioned perpendicularly to the plane of the top panel 14 and the bottom panel 16 which are essentially parallel to each other. Forming the carton in this manner provides a desirable degree of strength and facilitates sealing of the inner surface of the outer side wall panels to the outer surface of the inner side wall panels.

What is claimed is:

1. A one-piece foldable blank for forming a wedge-shaped carton having a slanted end wall, said carton comprising:

a triangular bottom panel having a base edge and two side edges;

a trapezoidal end wall having top, bottom and side edges, with said bottom edge of said end wall and said base edge of said bottom panel being hingedly connected and of equal length, and with corner flaps being respectively connected to the side edges of said trapezoidal end wall;

a triangular top panel having a base edge and two side edges with the length of the base edge of said top panel being greater than the length of the base edge of said bottom panel, and with the length of said top panel measured along an imaginary line extending perpendicularly from the associated base edge to the opposed apex thereof being greater than the length of said bottom panel measured along an imaginary line extending perpendicularly from the associated base edge to the opposed apex thereof, said base edge of said top panel being hingedly connected and of equal length to the top edge of said trapezoidal end wall;

a pair of side wall panels extending from and hingedly connected to the associated side edges of said triangular top and bottom panels, with each side panel of one pair of said side wall panels including a pair of spaced, intermittent cut lines extending along the length thereof and defining a tear strip to permit easy opening of the erected carton which is of wedge-shaped configuration having a slanted trapezoidal end wall and which is useful for containing a wedge-shaped piece of pie having a slanted crust portion, with the carton conforming to the shape of said pie piece and with said sloping trapezoidal end wall functioning to provide increased protection and support to the slanted crust portion thereof, said base edge of said top panel being defined by at least a pair of spaced scorelines converging towards each other at their ends to enhance the protection of a pie piece within said carton by precluding contact of the pie piece with an adjacent straight edge, a fold around flap is hingedly connected to the edge of one side wall panel extending from said bottom panel, said fold around flap being disposed adjacent the apex of said triangular bottom panel, said converging scorelines defining said edge including a convex and facing concave scoreline.

2. A one-piece foldable blank for forming a wedge-shaped carton having a slanted end wall, said carton comprising:

a triangular bottom panel having a base edge and two side edges;

a trapezoidal end wall having top, bottom and side edges, with said bottom edge of said end wall and said base edge of said bottom panel being hingedly connected and of equal length, and with corner flaps being respectively hingedly connected to the side edges of said trapezoidal end wall;

a triangular top panel having a base edge and two side edges with the length of the base edge of said top panel being greater than the length of the base edge of said bottom panel, and with the length of said top panel measured along an imaginary line extending perpendicularly from the associated base edge to the opposed apex thereof being greater than the length of said bottom panel measured along an imaginary line extending perpendicularly from the associated base edge to the opposed apex thereof, said base edge of said top panel being hingedly connected and of equal length to the top edge of said trapezoidal end wall;

a pair of side wall panels extending from and hingedly connected to the associated side edges of said triangular top and bottom panels, with each side wall panel of one pair of said side wall panels including a pair of spaced, intermittent cut lines extending along the length thereof and defining a tear strip to permit easy opening of the erected carton which is of wedge-shaped configuration having a slanted trapezoidal end wall and which is useful for containing a wedge-shaped piece of pie having a slanted crusted portion, with the carton conforming to the shape of said pie piece and with said sloping trapezoidal end wall functioning to provide increased protection and support to the slanted crust portion thereof, said side edges of said top panel being defined by at least a pair of spaced scorelines converging towards each other at their ends to enhance the protection of a pie piece within said carton by precluding contact of the pie piece with an adjacent straight edge, a fold around flap is hingedly connected to the edge of one side wall panel extending from said bottom panel, said fold around flap being disposed adjacent the apex of said triangular bottom panel, the upper edges of said other pair of side wall panels being contoured to match the contours of said convering scorelines.

3. A blank according to claim 2 wherein said converging scorelines defining said edge include a convex and facing concave scoreline.

4. A blank according to claim 2 wherein said converging scorelines defining said edge form a quadrilateral.

* * * * *